US009746169B2

(12) United States Patent
Rapp et al.

(10) Patent No.: US 9,746,169 B2
(45) Date of Patent: Aug. 29, 2017

(54) LIGHT WITH A FILM FOR ALTERING THE RADIATION CHARACTERISTICS

(75) Inventors: Jürgen Rapp, Erschbronn (DE); Clemens Hummel, Villingen-Schwenningen (DE)

(73) Assignee: HERBERT WALDMANN GMBH & CO. KG, Villingen-Schwenningen (DE)

( * ) Notice: Subject to any disclaimer, the term of this patent is extended or adjusted under 35 U.S.C. 154(b) by 43 days.

(21) Appl. No.: 14/241,017

(22) PCT Filed: Sep. 6, 2012

(86) PCT No.: PCT/DE2012/100270
§ 371 (c)(1),
(2), (4) Date: May 11, 2016

(87) PCT Pub. No.: WO2013/034152
PCT Pub. Date: Mar. 14, 2013

(65) Prior Publication Data

US 2016/0245496 A1 Aug. 25, 2016

(51) Int. Cl.

| | |
|---|---|
| ***F21V 29/507*** | (2015.01) |
| ***F21V 29/74*** | (2015.01) |
| ***F21V 3/00*** | (2015.01) |
| ***F21V 3/04*** | (2006.01) |
| ***F21V 5/00*** | (2015.01) |
| ***F21V 11/16*** | (2006.01) |
| ***F21V 15/01*** | (2006.01) |

(Continued)

(52) U.S. Cl.
CPC ..... *F21V 29/507* (2015.01); *F21V 3/00* (2013.01); *F21V 3/0445* (2013.01); *F21V 5/002* (2013.01); *F21V 11/16* (2013.01); *F21V 15/01* (2013.01); *F21V 17/02* (2013.01); *F21V 17/10* (2013.01); *F21V 17/101* (2013.01); *F21V 29/74* (2015.01);
(Continued)

(58) Field of Classification Search
CPC ..... F21V 29/507; F21V 29/74; F21V 3/00; F21V 3/044; F21V 5/002; F21V 11/16; F21V 15/01; F21V 17/02; F21V 17/10; F21V 17/101; F21V 29/004; F21Y 2105/10; F21Y 2115/10; F21Y 2101/00;
(Continued)

(56) References Cited

U.S. PATENT DOCUMENTS

| | | | |
|---|---|---|---|
| 3,771,245 | A | 11/1973 | Mabrey et al. |
| 4,969,075 | A | 11/1990 | Helm et al. |

(Continued)

FOREIGN PATENT DOCUMENTS

| | | | |
|---|---|---|---|
| CN | 201057422 | Y | 5/2008 |
| DE | 10 2005 000 951 | A1 | 1/2005 |

(Continued)

OTHER PUBLICATIONS

Translation of EP1092919A2 by Google Patents; dated Oct. 15, 2016; 11 pages.*

(Continued)

*Primary Examiner* — Laura Tso
(74) *Attorney, Agent, or Firm* — Juneau & Mitchell

(57) ABSTRACT

Light with housing, a plurality of illuminants arranged in the housing, a covering disc that closes the housing in the direction of radiation and a film for altering the radiation characteristics of the illuminants, which is arranged in front of the illuminants in the direction of radiation, wherein the film is arranged between the covering disc and a supporting disc, wherein the film is in direct contact with the two discs.

15 Claims, 2 Drawing Sheets

(51) Int. Cl.

| | |
|---|---|
| ***F21V 17/02*** | (2006.01) |
| ***F21V 17/10*** | (2006.01) |
| *F21V 29/00* | (2015.01) |
| *F21W 131/402* | (2006.01) |
| *F21W 131/403* | (2006.01) |
| *F21Y 105/10* | (2016.01) |
| *F21Y 115/10* | (2016.01) |
| *F21Y 101/00* | (2016.01) |

(52) U.S. Cl.
CPC ..... *F21V 29/004* (2013.01); *F21W 2131/402* (2013.01); *F21W 2131/403* (2013.01); *F21Y 2101/00* (2013.01); *F21Y 2105/10* (2016.08); *F21Y 2115/10* (2016.08)

(58) Field of Classification Search
CPC ..... F21Y 2101/02; F21W 2131/402; F21W 2131/403
USPC ..... 362/97.1, 97.2, 97.3, 97.4
See application file for complete search history.

(56) References Cited

U.S. PATENT DOCUMENTS

| | | | | |
|---|---|---|---|---|
| 4,975,807 | A * | 12/1990 | Ohashi | B60K 37/02 362/23.01 |
| 7,609,333 | B2 | 10/2009 | Fukuda | |

FOREIGN PATENT DOCUMENTS

| | | | |
|---|---|---|---|
| DE | 10 2005 059 779 | A1 | 12/2005 |
| DE | 10 2008 027 220 | A1 | 6/2008 |
| DE | 202008004842 | U1 | 6/2008 |
| DE | 20 2008 004 842 | U1 | 7/2008 |
| DE | 20 2009 013 088 | U1 | 9/2009 |
| DE | 20 2010 001 814 | U1 | 2/2010 |
| DE | 202009013088 | U1 | 2/2011 |
| EP | 1092919 | A2 | 4/2001 |
| EP | 1 586 813 | A1 | 10/2005 |
| EP | 1586813 | A1 | 10/2005 |
| JP | 10-105074 | | 4/1998 |
| JP | H10-105074 | A | 4/1998 |

OTHER PUBLICATIONS

German Office Action issued Feb. 4, 2016 in corresponding Japanese patent application No. 10 2011 082 424.3.
Japanese Office Action issued Feb. 17, 2015 in corresponding Japanese patent application No. 2014-528857.
Chinese Office Action issued Feb. 8, 2015 in corresponding Chinese patent application No. 201280043458.4.
WIPO International Search Report for PCT/DE2012/100270 issued Feb. 7, 2013.

* cited by examiner

LIGHT WITH A FILM FOR ALTERING THE RADIATION CHARACTERISTICS

CROSS REFERENCE TO RELATED APPLICATIONS

This patent application claims priority to International Patent Application PCT/DE2012/100270, filed on Sep. 6, 2012 and thereby to German Patent Application 10 2011 082 424.3, filed on Sep. 9, 2011.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention relates to a light box with a film for altering the radiation characteristics Background of the Invention The current state of knowledge is as follows.

Radiation-reducing lights generally comprise a housing with a plurality of illuminants arranged in it. In the front, the housing is closed with a covering plate in the direction of radiation. Furthermore, a film is arranged in front of the illuminants in the direction of radiation, said film altering the radiation characteristics of the illuminants, for example homogenizing the emitted light or guiding it into a certain direction.

A film for homogenizing the emitted light may be required for example in the event that the illuminants arranged in the housing generate a plurality of light cones, which would subsequently cast a plurality of shadows if the light is used for instance as a work or machine light. To prevent this from happening, a so-called diffuser film is required, which diffuses the individual light-emitting cones by optical refraction and hence prevents the casting of individual shadows. Furthermore, said type of film can bring about the shaping of the light-emitting cones of the individual illuminants, for example by deflecting them to a certain angle of radiation.

The problem associated with high-energy illuminants is that the materials used for the light are expanding at different degrees due to their different coefficients of thermal expansion, thus inducing thermal stresses. Said thermal stresses may result in corrugation and blistering of the film, especially if the film is affixed on the covering plate or clamped into the housing, such that the luminous properties of the film are lost due to the high coefficient of thermal expansion a of the film, which ranges between 70 and $80\times10^{-6}$ $K^{-1}$. In comparison, the coefficient of thermal expansion of a housing made of aluminum is close to $23\times10^{-6}K^{-1}$ and between 3 and $4.5\times10^{-6}$ $K^{-1}$ with the used plates. Because of these major differences, in particular a strong expansion of the film can result in considerable structural warpage, i.e., blistering or corrugation.

Moreover, lights have been disclosed in which light spots with a high luminance, produced for example with LED illuminants, are slightly scattered or homogenized by the [satin finish] of the covering plate, albeit without preventing the casting of multiple shadows. Guiding the light through lenses arranged in front of the illuminants does not resolve this problem either.

The object of the present invention is to resolve the problems mentioned above.

BRIEF SUMMARY OF THE INVENTION

In a preferred embodiment, a light box (1) with a housing (10), a plurality of illuminants (3) arranged in the housing (10), a covering plate (5) that closes the housing (10) in the direction of radiation (A) and a film (6) for altering the radiation characteristics of the illuminants (3), which is arranged in front of the illuminants (3) in the direction of radiation (A), characterized in that the film (6) is arranged between the covering plate (5) and a supporting plate (7), wherein the film (6) is in direct contact with the two plates (5, 7).

The light box (1) as described herein, wherein the film (6) is mounted non-adhesively.

The light box (1) as described herein, wherein at least one of the plates (5, 7) is mounted resiliently.

The light box (1) as described herein, wherein the supporting plate (7) is mounted resiliently.

The light box (1) as described herein, wherein the covering plate (5) is mounted resiliently.

The light box (1) as described herein, wherein the supporting plate (7) is arranged on the side of the film (6) facing the illuminants (3).

The light box (1) as described herein, wherein the supporting plate (7) sits on a support bearing.

The light box (1) as described herein, further comprising wherein at least one cured adhesive bead is provided as support bearing.

The light box (1) as described herein, further comprising wherein two adhesive beads are provided, which are arranged on opposite side walls of the supporting plate (7) or the housing (10).

The light box (1) as described herein, wherein the covering plate (5) is mounted under compressive load in the direction of the supporting plate (7) in the housing (10).

The light box (1) as described herein, wherein the covering plate (5) has a peripheral adhesive bond with the housing (10).

The light box (1) as described herein, wherein the film (6) is kept in the center by way of a screen (18).

The light box (I) as described herein, wherein a screen (18) is arranged on the covering plate (5), in particular printed onto the covering plate (5).

The light box (1) as described herein, wherein the screen (18) runs around the entire periphery.

DETAILED DESCRIPTION OF THE INVENTION

Figure 1:
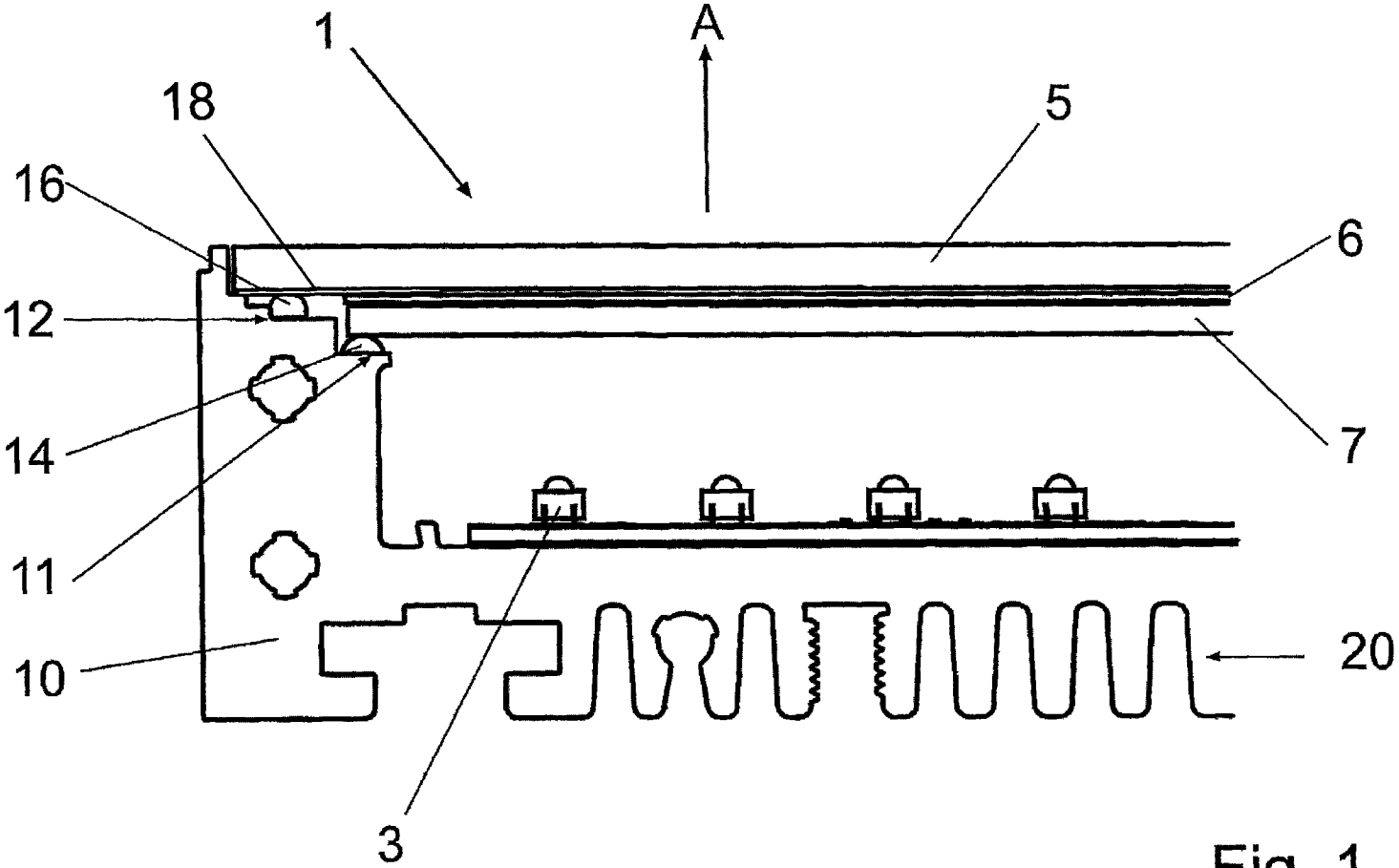
FIG. 1 is a line drawing evidencing a cross-section through a light box according to the invention

A light box according to the invention comprises a housing with a plurality of illuminants arranged in it. The housing is closed with a covering plate in the direction of radiation and additionally comprises a film for altering the radiation characteristics of the illuminants, said film being arranged in front of the illuminants in the direction of radiation. According to the invention, the light box is characterized in that the film is arranged between the covering plate and a supporting plate, wherein the film is in direct contact with the two plates.

Because the film for altering the radiation characteristics of the illuminants is arranged between the covering plate and the supporting plate and is in direct contact with the two plates, a floating mount of the film between said plates is achieved, such that the film is able to perform compensating movements in all directions, but in particular in lengthwise and transverse direction of the film in response to heat-induced expansion, thus preventing blistering or corrugation. An additional advantage of the floating mount of the film is that it can be mounted between the plates without any adhesives. As a result, the film can expand or contract independent of the plates and is therefore mounted stress-free—even if the coefficients of thermal expansion of the used materials vary considerably.

In an advantageous upgrade of the invention, at least one of the plates is mounted resiliently.

The resilient mount of at least one of the plates achieves that a change in the thickness of the film can also be compensated. Furthermore, the resilient mount of at least one of the plates achieves that the film can be mounted pre-stressed in the direction of radiation, i.e., in the direction of its thickness, such that blistering or corrugation can additionally be prevented in this fashion.

A particularly simple embodiment can be achieved if the supporting plate is mounted resiliently.

The resilient mount of the supporting plate has the advantage that the covering plate, which is generally arranged behind the supporting plate in the direction of radiation and covers the housing toward the outside, can rigidly be connected with the housing and in particular the effort required to create the impermeability towards the surroundings is lower.

However, if desired, the covering plate can also be mounted resiliently; for instance, it can be interlocked with the housing.

As mentioned earlier, it is advantageous if the supporting plate is arranged on the side facing the illuminants.

The supporting plate can be mounted for example with a support bearing. The advantage of a support bearing is that an expansion of the supporting plate in lengthwise and transversal direction is not impeded by its mount in this fashion, such that the supporting plate can essentially be arranged stress-free within the housing.

A simple embodiment of said type of support bearing can be achieved with a cured adhesive bead. Said type of cured adhesive bead can be arranged for example on opposite side walls of the supporting plate or in corresponding locations on the housing. If said adhesive bead is applied and cured before the supporting plate is inserted into the housing, it features a certain degree of flexibility after being cured and the supporting plate can be mounted resiliently, while at the same time allowing an expansion of the supporting plate in lengthwise and transversal direction.

Alternatively to cured adhesive beads, other support bearings with a flexible design can also be used. One conceivable alternative would be an O-ring arranged around the entire periphery.

A particularly effective prevention of blistering or corrugation is achieved if the covering plate is mounted in the housing under compressive load in the direction of the supporting plate. The film can be kept flat between the plates by a certain contact pressure exerted by the covering plate in the direction of the supporting plate and absorbed by the resilient support bearing.

A particularly simple mount of the covering plate can be achieved by way of adhesion provided all around the housing. Furthermore, the housing can be sealed toward the surroundings with said type of peripheral adhesion.

In addition, it is advantageous if the film is kept in the center with a screen. For this purpose, the screen can preferably have a peripheral design, where it should be made sure that the expansion of the film in lengthwise and transversal direction is still possible.

Alternatively, the screen can only be printed onto the covering plate, such that the film can expand across the entire spread of the plate.

DETAILED DESCRIPTION OF THE FIGURES

FIG. 1 shows a cross-section through a light box 1 according to the invention. The light box 1 comprises a housing 10 with a base plate and a peripheral side wall, with a plurality of illuminants 3 arranged in it. In the present example, the illuminants 3 are designed as light-emitting diodes (LEDs) and distributed uniformly on the base plate of the housing 10. To allow for the removal of lost heat created by the light-emitting diodes, the housing 10 can advantageously be made of aluminum and have a plurality of cooling ribs 20 arranged on the outside of the base plate. In the direction of radiation A, a supporting plate 7, a film 6 altering the radiation characteristics of the illuminants 3 and a covering plate 5 are arranged in the housing 10 in the fashion of a sandwich structure.

The supporting plate 7 is mounted on an elastic bearing arranged on a first step 11 that runs around the entire periphery. In the present exemplary embodiment, the elastic bearing 14 is created by a cured adhesive bead that was applied prior to the mounting of the supporting plate 7. In the present exemplary embodiment, the adhesive bead is only applied onto the first step 11 at the two side walls of the housing 10.

This allows the supporting plate 7 to expand both in lengthwise and transversal direction in response to thermal exposure and it is hence mounted floating in the housing. Another relevant feature of said floating mount is that the supporting plate 7 has an adequate distance around the entire periphery from the side wall of the housing 10, which continues in a second step 12.

A film 6 altering the radiation characteristics of the illuminants 3 is arranged in the center of the supporting plate 7. In the present exemplary embodiment, the screen 18 is printed onto the covering plate 5, such that adequate clearance is provided for the film 6 and the screen 18 to allow thermal expansions in lengthwise and transversal direction. The boundary area of the film 6 is therefore covered from the outside of the light box and hence invisible.

The film 6 can in particular be designed as light-guiding film 6 that homogenizes the radiation characteristics.

The covering plate 5 is mounted in the housing 10 on the second step 12 by means of peripheral adhesion 16 and pushed into the housing 10 during the mounting in the housing 10 against the spring-loaded effect applied to the elastic mount 14. As a result, the film 6 is mounted under compressive load between the supporting plate 7 and the covering plate 5 such that heat-induced blistering or corrugation of the film 6 can effectively be prevented.

Figure 2:
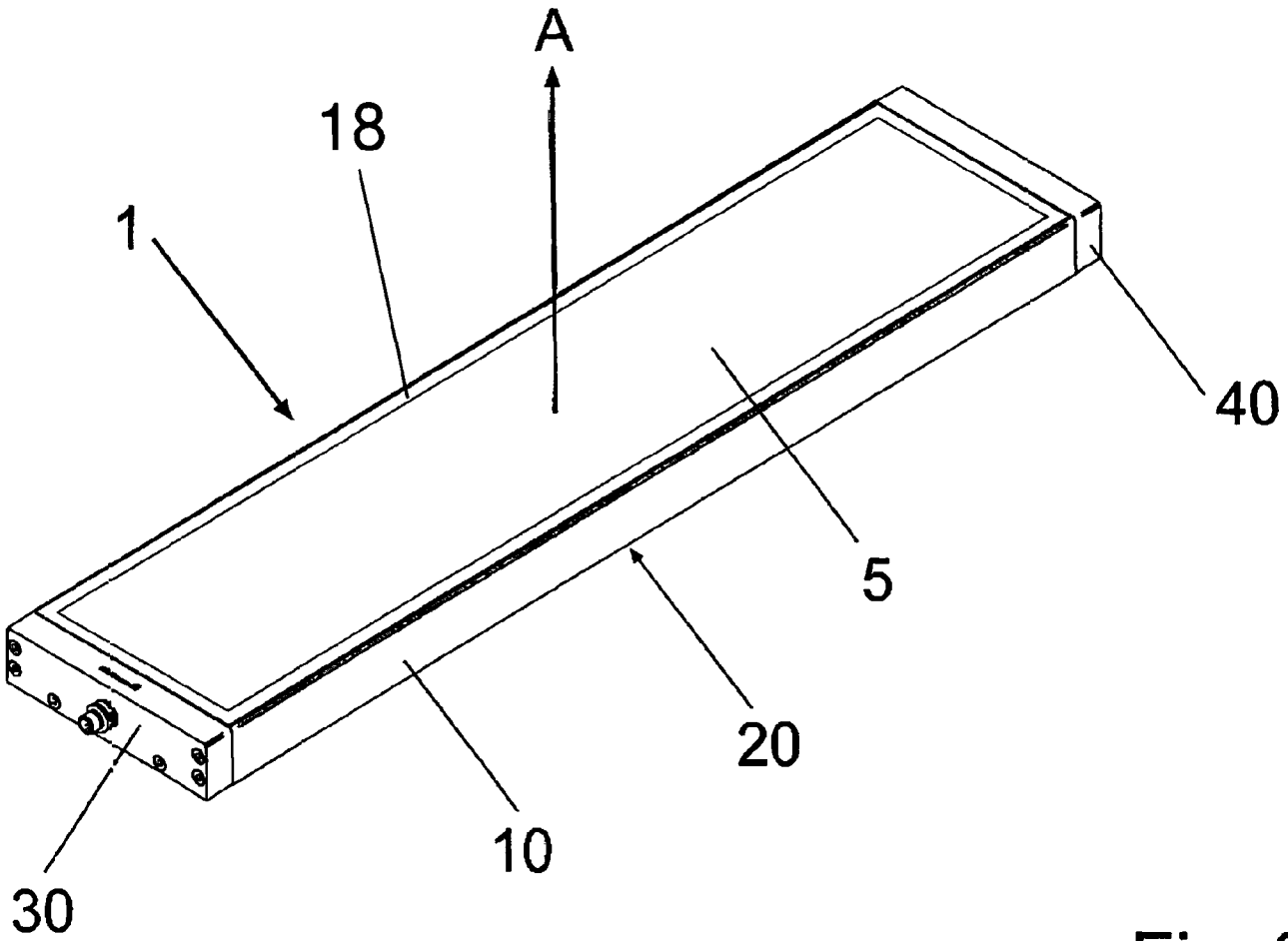
FIG. 2 is a line drawing evidencing a perspective representation of the light box in FIG. 1.

FIG. 2 shows a perspective representation of the light box 1 according to the invention as it is illustrated in the cross-section in FIG. 1.

The trough-shaped housing 10 of the light box 1, which is closed by the covering plate 5 in the direction of radiation, is particularly well visible in FIG. 2. On one end, the long stretched-out housing 10 is closed with a side part 30 having a connector plug, and on the other end with a side part 40 designed without a connector plug in the present exemplary embodiment. The two side parts 30, 40 are screwed down with the housing 10 in lengthwise direction of the light box 1.

Furthermore, the screen 18 printed onto the covering plate 5 is clearly visible in FIG. 2, which covers both the peripheral adhesion 16 applied to the boundary area of the covering plate 5 as well as the boundary area of the film 6, such that they are invisible from the outside.

The cooling ribs 20 at the underside of the housing 10 illustrated in FIG. 1 are not shown in FIG. 2. They are formed behind a rim of the housing 10 that runs around the entire periphery, such that a closed side wall of the housing 10 is visible toward the outside.

LIST OF REFERENCE NUMBERS

1 Light box
3 Illuminant(s)
5 Covering plateplate
6 Film
7 Supporting plateplate
10 Housing
11 First step
12 Second step
14 Elastic bearing
16 Peripheral adhesion
18 Screen
20 Cooling ribs
A Direction of radiation The references recited herein are incorporated herein in their entirety, particularly as they relate to teaching the level of ordinary skill in this art and for any platelosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

We claim:

1. A light box comprising a housing, a plurality of illuminants arranged in the housing, a covering plate that closes the housing in the direction of radiation and a film for altering the radiation characteristics of the illuminants, which is arranged in front of the illuminants in the direction of radiation, wherein the film is arranged between the covering plate and a supporting plate, wherein the film is in direct contact with the two plates, wherein the supporting plate is mounted on an elastic bearing arranged on a first step that runs around the entire circumference, wherein the covering plate is mounted in the housing on the second step by means of peripheral adhesion.

2. The light box of claim 1, wherein the film is mounted non-adhesively.

3. The light box of claim 1, wherein at least one of the plates is mounted resiliently.

4. The light box of claim 3, wherein the supporting plate is mounted resiliently.

5. The light box of claim 3, wherein the covering plate is mounted resiliently.

6. The light box of claim 1, wherein the supporting plate is arranged on the side of the film facing the illuminants.

7. The light box of claim 1, wherein the supporting plate sits on a support bearing.

8. The light box of claim 7, wherein at least one cured adhesive bead is provided as support bearing.

9. The light box of claim 8, further comprising wherein two adhesive beads are provided, which are arranged on opposite side walls of the supporting plate or the housing.

10. The light box of claim 1, wherein the covering disc is mounted under compressive load in the direction of the supporting plate in the housing.

11. The light box of claim 1, wherein the covering plate has a peripheral adhesive bond with the housing.

12. The light box of claim 1, wherein the film is kept in the center by way of a screen.

13. The light of claim 1, wherein a screen is arranged on the covering plate.

14. The light of claim 1, wherein the screen runs around the entire periphery.

15. The light of claim 1, wherein a screen is printed onto the covering plate.

* * * * *